US006321393B1

(12) United States Patent
Jones

(10) Patent No.: US 6,321,393 B1
(45) Date of Patent: Nov. 27, 2001

(54) AUTOMATED TOILET SEAT LOWERING DEVICE

(76) Inventor: Darryl A. Jones, 5502 W. Lawrence Ave. Apt. 308, Chicago, IL (US) 60630

( * ) Notice: Subject to any disclaimer, the term of this patent is extended or adjusted under 35 U.S.C. 154(b) by 0 days.

(21) Appl. No.: 09/797,657

(22) Filed: Mar. 5, 2001

(51) Int. Cl.[7] ..... A47K 13/10
(52) U.S. Cl. ..... 4/246.1
(58) Field of Search ..... 4/246.1–246.5

(56) References Cited

U.S. PATENT DOCUMENTS

| | | | |
|---|---|---|---|
| D. 161,108 | 12/1950 | Kandarian . | |
| 3,404,411 | 10/1968 | Newkirk . | |
| 5,153,946 | 10/1992 | Yoke et al. . | |
| 5,311,619 | 5/1994 | Ward . | |
| 5,603,127 * | 2/1997 | Veal | 4/246.1 |
| 5,878,444 | 3/1999 | Convoy . | |
| 5,884,342 | 3/1999 | Maake . | |
| 6,226,804 * | 5/2001 | Ballard | 4/246.1 |

* cited by examiner

*Primary Examiner*—Gregory L. Huson
*Assistant Examiner*—Tuan Nguyen

(57) ABSTRACT

A automated toilet seat lowering device for lowering a raised toilet seat after a predetermined amount of time. The automated toilet seat lowering device includes a motor for rotating a spindle securely attached to a toilet seat. The motor is mechanically coupled to the spindle. The spindle is generally coaxial with hinges hingedly coupling the toilet seat to the toilet. The motor rotates the spindle to lower the toilet seat downward from a raised position. A housing is mountable to a wall. The housing has a front side facing outwardly away from the wall. Control circuitry adapted for actuating the motor, tracking elapsed time and receiving an electrical signal from a sensor is positioned in the housing and electrically coupled to the motor. A sensor for detecting motion is positioned on the front side of the housing is electrically coupled to the control circuitry. The sensor sends electrical signals to the control circuitry when the sensor detects movement. The control circuitry actuates the motor when the control circuitry does not receive a signal from the sensor after predetermined amount of elapsed time.

4 Claims, 4 Drawing Sheets

AUTOMATED TOILET SEAT LOWERING DEVICE

BACKGROUND OF THE INVENTION

1. Field of the Invention

The present invention relates to toilet seat lowering devices and more particularly pertains to a new automated toilet seat lowering device for lowering a raised toilet seat after a predetermined amount of time.

2. Description of the Prior Art

The use of toilet seat lowering devices is known in the prior art. More specifically, toilet seat lowering devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,311,619; U.S. Pat. No. 5,878,444; U.S. Pat. No. 5,153,946; U.S. Pat. No. 5,884,342; U.S. Pat. No. 3,404,411; and U.S. Des. Pat. No. 161 ,108.

While these devices fulfill their respective, particular objectives and requirements, the aforementioned patents do not disclose a new automated toilet seat lowering device. The inventive device includes a motor for rotating a spindle securely attached to a toilet seat. The motor is mechanically coupled to the spindle. The spindle is generally coaxial with hinges hingedly coupling the toilet seat to the toilet. The motor rotates the spindle to lower the toilet seat downward from a raised position. A housing is mountable to a wall. The housing has a front side facing outwardly away from the wall. Control circuitry adapted for actuating the motor, tracking elapsed time and receiving an electrical signal from a sensor is positioned in the housing and electrically coupled to the motor. A sensor for detecting motion is positioned on the front side of the housing is electrically coupled to the control circuitry. The sensor sends electrical signals to the control circuitry when the sensor detects movement. The control circuitry actuates the motor when the control circuitry does not receive a signal from the sensor after predetermined amount of elapsed time.

In these respects, the automated toilet seat lowering device according to the present invention substantially departs from the conventional concepts and designs of the prior art, and in so doing provides an apparatus primarily developed for the purpose of lowering a raised toilet seat after a predetermined amount of time.

SUMMARY OF THE INVENTION

In view of the foregoing disadvantages inherent in the known types of toilet seat lowering devices now present in the prior art, the present invention provides a new automated toilet seat lowering device construction wherein the same can be utilized for lowering a raised toilet seat after a predetermined amount of time.

The general purpose of the present invention, which will be described subsequently in greater detail, is to provide a new automated toilet seat lowering device apparatus and method which has many of the advantages of the toilet seat lowering devices mentioned heretofore and many novel features that result in a new automated toilet seat lowering device which is not anticipated, rendered obvious, suggested, or even implied by any of the prior art toilet seat lowering devices, either alone or in any combination thereof.

To attain this, the present invention generally comprises a motor for rotating a spindle securely attached to a toilet seat. The motor is mechanically coupled to the spindle. The spindle is generally coaxial with hinges hingedly coupling the toilet seat to the toilet. The motor rotates the spindle to lower the toilet seat downward from a raised position. A housing is mountable to a wall. The housing has a front side facing outwardly away from the wall. Control circuitry adapted for actuating the motor, tracking elapsed time and receiving an electrical signal from a sensor is positioned in the housing and electrically coupled to the motor. A sensor for detecting motion is positioned on the front side of the housing is electrically coupled to the control circuitry. The sensor sends electrical signals to the control circuitry when the sensor detects movement. The control circuitry actuates the motor when the control circuitry does not receive a signal from the sensor after predetermined amount of elapsed time.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automated toilet seat lowering device apparatus and method which has many of the advantages of the toilet seat lowering devices mentioned heretofore and many novel features that result in a new automated toilet seat lowering device which is not anticipated, rendered obvious, suggested, or even implied by any of the prior art toilet seat lowering devices, either alone or in any combination thereof.

It is another object of the present invention to provide a new automated toilet seat lowering device which may be easily and efficiently manufactured and marketed.

It is a further object of the present invention to provide a new automated toilet seat lowering device which is of a durable and reliable construction.

An even further object of the present invention is to provide a new automated toilet seat lowering device which is susceptible of a low cost of manufacture with regard to both materials and labor, and which accordingly is then susceptible of low prices of sale to the consuming public, thereby making such automated toilet seat lowering device economically available to the buying public.

Still yet another object of the present invention is to provide a new automated toilet seat lowering device which provides in the apparatuses and methods of the prior art some of the advantages thereof, while simultaneously overcoming some of the disadvantages normally associated therewith.

Still another object of the present invention is to provide a new automated toilet seat lowering device for lowering a raised toilet seat after a predetermined amount of time.

Yet another object of the present invention is to provide a new automated toilet seat lowering device which includes a motor for rotating a spindle securely attached to a toilet seat. The motor is mechanically coupled to the spindle. The spindle is generally coaxial with hinges hingedly coupling the toilet seat to the toilet. The motor rotates the spindle to lower the toilet seat downward from a raised position. A housing is mountable to a wall. The housing has a front side facing outwardly away from the wall. Control circuitry adapted for actuating the motor, tracking elapsed time and receiving an electrical signal from a sensor is positioned in the housing and electrically coupled to the motor. A sensor for detecting motion is positioned on the front side of the housing is electrically coupled to the control circuitry. The sensor sends electrical signals to the control circuitry when the sensor detects movement. The control circuitry actuates the motor when the control circuitry does not receive a signal from the sensor after predetermined amount of elapsed time.

Still yet another object of the present invention is to provide a new automated toilet seat lowering device that is retrofittable to existing toilets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
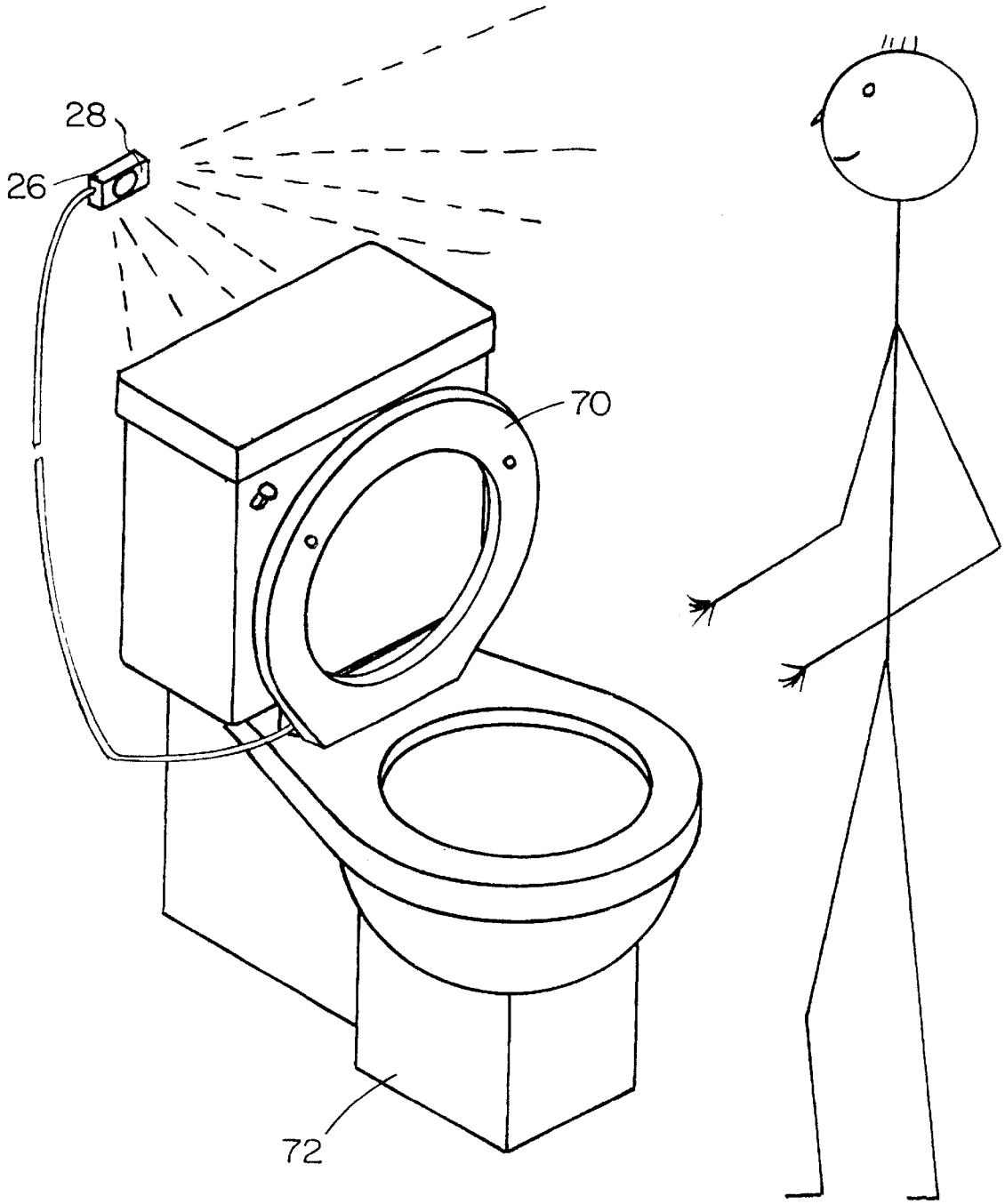
FIG. 1 is a schematic perspective view of a new automated toilet seat lowering device according to the present invention.
Figure 2:
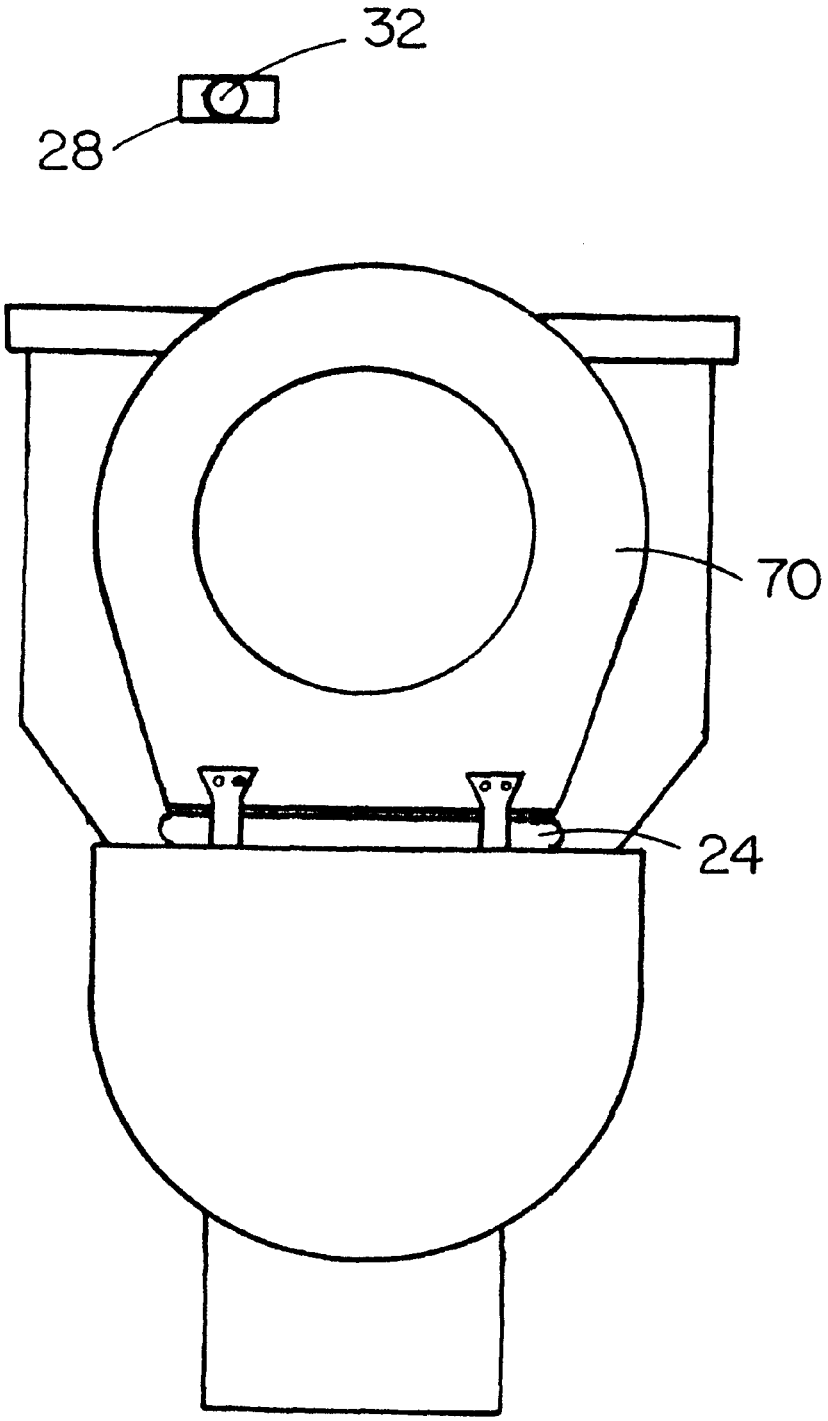
FIG. 2 is a schematic front view of the present invention.
Figure 3:
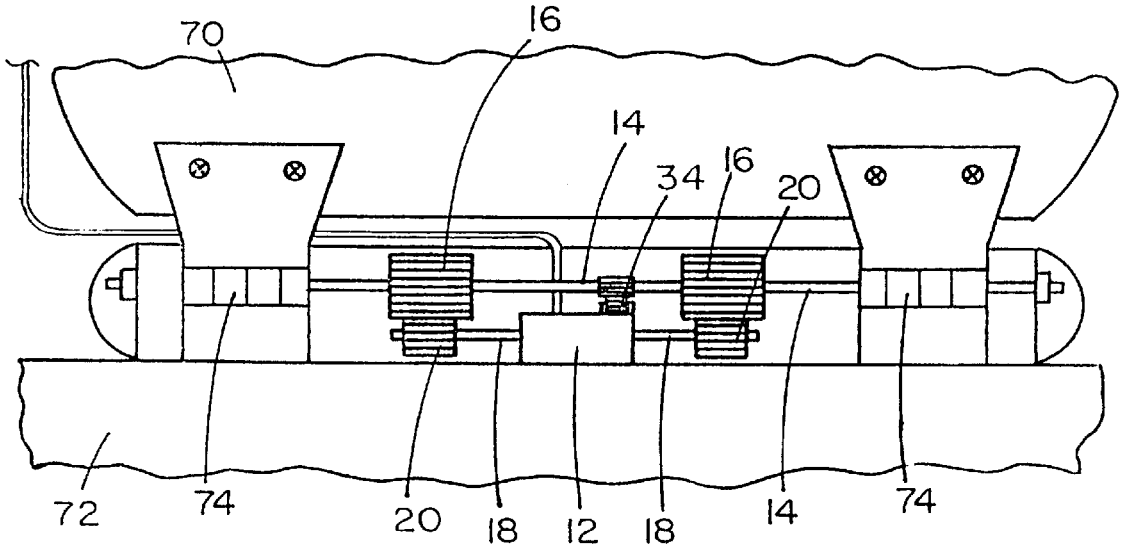
FIG. 3 is a schematic front view of the motor and spindle of the present invention.
Figure 4:
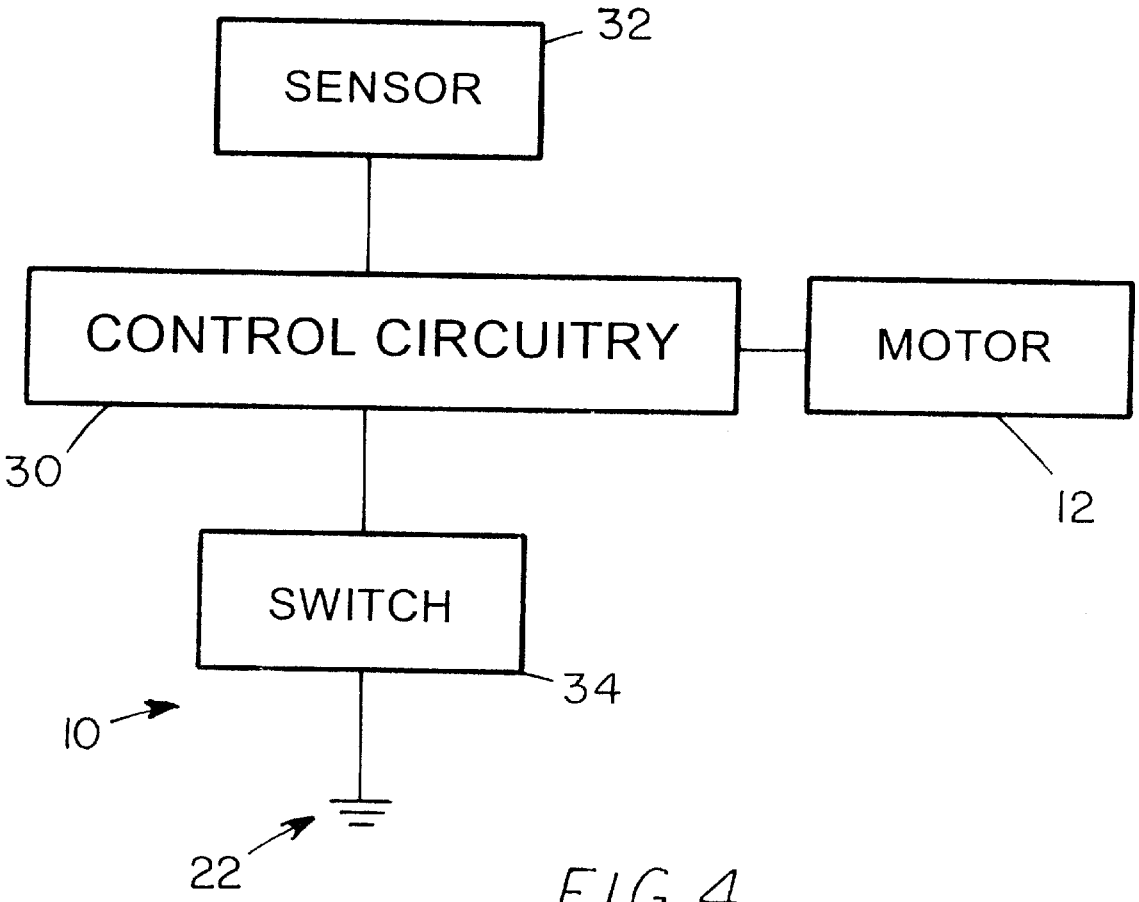
FIG. 4 is an electronic schematic of the present invention.

With reference now to the drawings, and in particular to FIGS. 1 through 4 thereof, a new automated toilet seat lowering device embodying the principles and concepts of the present invention and generally designated by the reference numeral 10 will be described.

As best illustrated in FIGS. 1 through 4, the automated toilet seat lowering device 10 generally comprises a device for automatically lowering a toilet seat 70 which is hingedly coupled to a toilet 72 by a pair of hinges 74. The device 10 includes a motor 12 for rotating a spindle 14 securely attached to the toilet seat 70. The motor 12 is securely attached to the toilet and positioned between the hinges 74. The spindle 14 is generally coaxial with each of the hinges 74. The spindle 14 extends through and is securely coupled to a plurality of gears 16. A pair of rods 18 is coupled to and extends outwardly of the motor 12. Each of the rods 18 has a gear 20 thereon positioned for engaging one of the plurality of gears 16 of on the spindle 14. The motor 12 rotates the rods 18 and the gears 20 on the rods 18 rotate the gears 20 on the spindle 14 to lower the toilet seat 70 downward from a raised position. The motor 12 is ideally an electric motor. A power supply 22, preferably a plurality of batteries, is electrically coupled to the motor 12. Also envisioned is an enclosure 24 containing the motor 12 and spindle 14, which has toilet seat 70 hingedly coupled thereto.

A housing 26 is mountable to a wall. The housing 26 has a front side 28 facing outwardly away from the wall. The housing 26 is positioned near the toilet 72.

Control circuitry 30 adapted for actuating the motor 12, tracking elapsed time and receiving an electrical signal from a sensor is positioned in the housing 26 and electrically coupled to the motor 12.

A conventional sensor 32 for detecting motion is positioned on the front side 28 of the housing 26 and electrically coupled to the control circuitry 30. The sensor 32 sends electrical signals to the control circuitry 30 when the sensor detects movement.

A switch turns 34 the control circuitry 30 on and off. The switch 34 indicates when the toilet seat 70 is not in a generally horizontal position. The switch 34 is electrically coupled to the control circuitry 30 and mechanically coupled to the spindle 14.

In use, the switch 34 turns on the control circuitry 30 when the toilet seat 70 is not in the horizontal position such that the control circuitry 30 actuates the sensor 32. The control circuitry 30 actuates the motor 12 when the control circuitry 30 does not receive a signal from the sensor for a predetermined elapsed amount of time, which is preferably greater than 60 seconds. The switch 34 turns off the control circuitry 30 when the toilet seat 70 is in a horizontal position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automated toilet seat lowering device for automatically lowering a toilet seat which is hingedly coupled to a toilet by a pair of hinges, said device comprising:

a motor for rotating a spindle securely attached to said toilet seat, said motor being mechanically coupled to said spindle, said spindle being generally coaxial with each of said hinges, wherein said motor rotates said spindle to lower said toilet seat downward from a raised position;

a housing, said housing being mountable to a wall, said housing having a front side facing outwardly away from said wall;

control circuitry adapted for actuating said motor, tracking elapsed time and receiving an electrical signal from a sensor, said control circuitry being positioned in said housing and electrically coupled to said motor; said sensor being positioned on said front side of said housing and electrically coupled to said control circuitry, said sensor sending said electrical signal to said control circuitry when said sensor detects movement; and wherein said control circuitry actuates said motor to lower said toilet seat downward from a raised position when said control circuitry does not receive said signal from said sensor beyond a predetermined amount of elapsed time.

2. The automated toilet seat lowering device as in claim 1, wherein said spindle extends through and being securely coupled to a plurality of gears, a pair of rods being coupled to and extending outwardly of said motor, each of said rods having a gear thereon and positioned for engaging one of said plurality of gears of on said spindle, wherein said motor rotates said rods wherein said gears on said rods rotate said gears on said spindle to lower said toilet seat downward from said raised position.

3. The automated toilet seat lowering device as in claim 1, further including:

a switch for turning said control circuitry on and off, said switch indicating when said toilet seat is not in a generally horizontal position, said switch being electrically coupled to said control circuitry and mechanically coupled to said spindle; and wherein said switch turns on said control circuitry when said toilet seat is not in said horizontal position such that said control circuitry actuates said sensor, wherein said switch turns off said control circuitry when said toilet seat in a horizontal position.

4. An automated toilet seat lowering device for automatically lowering a toilet seat which is hingedly coupled to a toilet by a pair of hinges, said device comprising:

a motor for rotating a spindle securely attached to said toilet seat, said motor being securely attached to said toilet and positioned between said hinges, said spindle being generally coaxial with each of said hinges, said spindle extending through and being securely coupled to a plurality of gears, a pair of rods being coupled to and extending outwardly of said motor, each of said rods having a gear thereon and positioned for engaging one of said plurality of gears of on said spindle, wherein said motor rotates said rods wherein said gears on said rods rotate said gears on said spindle to lower said toilet seat downward from a raised position, said motor being an electric motor;

a housing, said housing being mountable to a wall, said housing having a front side facing outwardly away from said wall;

control circuitry adapted for actuating said motor, tracking elapsed time and receiving an electrical signal from a sensor, said control circuitry being positioned in said housing and electrically coupled to said motor; said sensor being positioned on said front side of said housing and electrically coupled to said control circuitry, said sensor sending said electrical signal to said control circuitry when said sensor detects movement;

a switch for turning said control circuitry on and off, said switch indicating when said toilet seat is not in a generally horizontal position, said switch being electrically coupled to said control circuitry and mechanically coupled to said spindle; and wherein said switch turns on said control circuitry when said toilet seat is not in said horizontal position such that said control circuitry actuates said sensor, wherein said control circuitry actuates said motor to lower said toilet seat downward from a raised position when said control circuitry does not receive said signal from said sensor for an elapsed amount of time greater than 60 seconds, wherein said switch turns off said control circuitry when said toilet seat is in a horizontal position.

* * * * *